US008151371B2

(12) United States Patent
Carpentier et al.

(10) Patent No.: US 8,151,371 B2
(45) Date of Patent: Apr. 10, 2012

(54) COLLAR CONFIGURATION FOR FIREFIGHTER GARMENT

(75) Inventors: Louis Carpentier, St-Denis de Brompton (CA); Lydia Lebel, St-Félix-de-Kingsey (CA); Ëric St-Arneault, Sherbrooke (CA)

(73) Assignee: Innotex Inc.

( * ) Notice: Subject to any disclaimer, the term of this patent is extended or adjusted under 35 U.S.C. 154(b) by 381 days.

(21) Appl. No.: 11/970,547

(22) Filed: Jan. 8, 2008

(65) Prior Publication Data

US 2008/0163404 A1 Jul. 10, 2008

Related U.S. Application Data

(60) Provisional application No. 60/883,897, filed on Jan. 8, 2007.

(51) Int. Cl.
*A41D 3/02* (2006.01)
*A62B 17/00* (2006.01)

(52) U.S. Cl. ..... 2/98; 2/81

(58) Field of Classification Search ..... 2/458, 7, 2/8.1, 468, 60, 97, 116, 129, 202, 206, 207, 2/98, 96, 90, 91, 93, 85, 94
See application file for complete search history.

(56) References Cited

U.S. PATENT DOCUMENTS

D18,983 S * 4/1889 House ..... D2/602
731,135 A * 6/1903 Scott ..... 2/206
985,668 A * 2/1911 Fischer ..... 2/98
1,159,761 A * 11/1915 Gibson ..... 2/129
1,378,142 A * 5/1921 Soresi ..... 2/129
1,524,107 A * 1/1925 Robbins ..... 2/98
1,732,245 A * 10/1929 Slotoroff ..... 2/98
1,886,056 A * 11/1932 Schwartz ..... 2/98
2,318,617 A * 5/1943 Miller ..... 2/98
2,688,137 A * 9/1954 Costa ..... 2/116
3,833,938 A * 9/1974 Shweid ..... 2/96
4,604,759 A * 8/1986 Bowman et al. ..... 2/81
4,686,710 A * 8/1987 Marston et al. ..... 2/468
4,708,129 A * 11/1987 Pujals, Jr. ..... 602/18
4,825,474 A * 5/1989 Edwards ..... 2/206
4,937,884 A * 7/1990 Sherman ..... 2/129
4,959,876 A * 10/1990 Kalaam et al. ..... 2/93
5,083,319 A * 1/1992 Grilliot et al. ..... 2/98
5,115,517 A * 5/1992 Ferguson et al. ..... 2/203
5,127,106 A * 7/1992 Aldridge ..... 2/81
5,153,941 A * 10/1992 Grilliot et al. ..... 2/98
5,167,037 A * 12/1992 Grilliot et al. ..... 2/98
5,189,737 A * 3/1993 Ribicic ..... 2/93
5,274,850 A * 1/1994 Aldridge ..... 2/84
5,297,295 A * 3/1994 Barbeau et al. ..... 2/96
5,406,648 A * 4/1995 Butzer et al. ..... 2/81
5,628,308 A * 5/1997 Harges et al. ..... 128/206.21

(Continued)

OTHER PUBLICATIONS

Fire-Dex, as found on internet website www.fire-dex.com.

(Continued)

*Primary Examiner* — Alissa L Hoey
(74) *Attorney, Agent, or Firm* — Norton Rose Canada LLP

(57) ABSTRACT

A jacket of the type used by firefighters as protective garment. A collar of the jacket comprises a lower edge connected to a shoulder/torso portion of the jacket in a straight seam. An upper exposed edge is spaced apart from the lower edge. A given shape is provided to the upper exposed edge such that a variable height is defined between the lower edge and the upper exposed edge along the upper exposed edge.

7 Claims, 8 Drawing Sheets

U.S. PATENT DOCUMENTS

| | | | | |
|---|---|---|---|---|
| 5,638,547 | A * | 6/1997 | Hewitt | 2/81 |
| 5,842,229 | A * | 12/1998 | Snedeker | 2/98 |
| 5,920,905 | A * | 7/1999 | Aldridge | 2/81 |
| 5,946,719 | A * | 9/1999 | Crupi et al. | 2/6.5 |
| 5,991,924 | A * | 11/1999 | Grilliot et al. | 2/98 |
| 6,163,891 | A * | 12/2000 | Viitalahti | 2/422 |
| 6,195,802 | B1 * | 3/2001 | Armellino | 2/102 |
| 6,243,872 | B1 * | 6/2001 | Snedeker | 2/81 |
| 6,260,207 | B1 * | 7/2001 | Barbeau et al. | 2/202 |
| 6,430,754 | B1 * | 8/2002 | Taylor et al. | 2/458 |
| 6,481,018 | B2 * | 11/2002 | Gagnon et al. | 2/98 |
| 6,490,735 | B2 * | 12/2002 | Rindle | 2/98 |
| 6,934,970 | B1 * | 8/2005 | Watkins et al. | 2/96 |
| 7,003,812 | B1 * | 2/2006 | Lewis et al. | 2/468 |
| 7,296,302 | B2 * | 11/2007 | DeLorenzo et al. | 2/84 |
| 7,676,855 | B2 * | 3/2010 | Dunn | 2/458 |
| 2002/0069453 | A1 * | 6/2002 | Kelleher et al. | 2/458 |
| 2006/0048293 | A1 * | 3/2006 | Lewis et al. | 2/468 |
| 2006/0253958 | A1 * | 11/2006 | Debrick | 2/206 |
| 2009/0025127 | A1 * | 1/2009 | McFie et al. | 2/468 |

OTHER PUBLICATIONS

Lion Apparel, as found on Internet website www.lionapparel.com.

Sperian Fire, as found on Internet website www.bacou-dalloz.ca.

Morning Pride, as found on internet website www.morningpride.com.

Globe Firefighter Suits, as found on Internet website www.globefiresuits.com.

* cited by examiner

COLLAR CONFIGURATION FOR FIREFIGHTER GARMENT

CROSS-REFERENCE TO RELATED APPLICATION

This patent application claims priority on U.S. Provisional Patent Application No. 60/883,897, filed on Jan. 8, 2007.

BACKGROUND OF THE APPLICATION

1. Field of the Application

The present application relates to firefighter garments and, more particularly, to a collar configuration for a protective firefighter jacket which helps to protect from fire, oppressive heat, water infiltration and elements while ergonomically adapting to the user's body specifics and protection equipment.

2. Background Art

Few working environments are as hostile as that of firefighters. In addition to the extreme heat from combustion/smoldering, a firefighter may be subjected to a variety of hazards: steam, pressurized water jet, falling debris—often burning, etc.

Therefore, protective garments used in firefighting must protect the firefighter from such extreme conditions. On the other hand, due to the nature of their job, firefighters must be capable of moving relatively freely to perform physically intensive actions. A firefighter may be required to break through some doors or walls, lift or displace objects, carry people in rescue situations, use an axe, hook or like tools, as well as maneuver a high-pressure water hose.

In the past, the collar of protective jackets for firefighters was restricted to a uniform height (i.e., fixed height) of 4 inches, as per an interpretation of the NFPA 1971 standards. This is illustrated in FIG. 1 of the prior art, in which a protective jacket 10 is shown having a collar 12 of uniform height, which essentially formed a circular edge of a cylinder with a storm flap 14. As such, the collar of protective jackets was not perfectly suited to the body shape/morphology of the users of these jackets. Moreover, as the protective jackets are worn in combination with other bulky equipment such as firefighter helmets, the uniform-height collars have been known to impede the movements of the firefighters.

SUMMARY OF THE APPLICATION

It is therefore an aim of the present application to provide a novel firefighter protective jacket.

Therefore, in accordance with the present invention, there is provided a jacket of the type used by firefighters as protective garment, wherein a collar of the jacket comprises a lower edge connected to a shoulder/torso portion of the jacket in a straight seam, an upper exposed edge spaced apart from the lower edge, and a given shape to the upper exposed edge such that a variable height is defined between the lower edge and the upper exposed edge along the upper exposed edge.

Further in accordance with the present invention, there is provided the clothing of firefighter composed of an outer shell retardant to the flames, a thermal liner to reduce heat and of a moisture barrier to avoid water infiltration.

DESCRIPTION OF THE PREFERRED EMBODIMENTS

Figure 1:
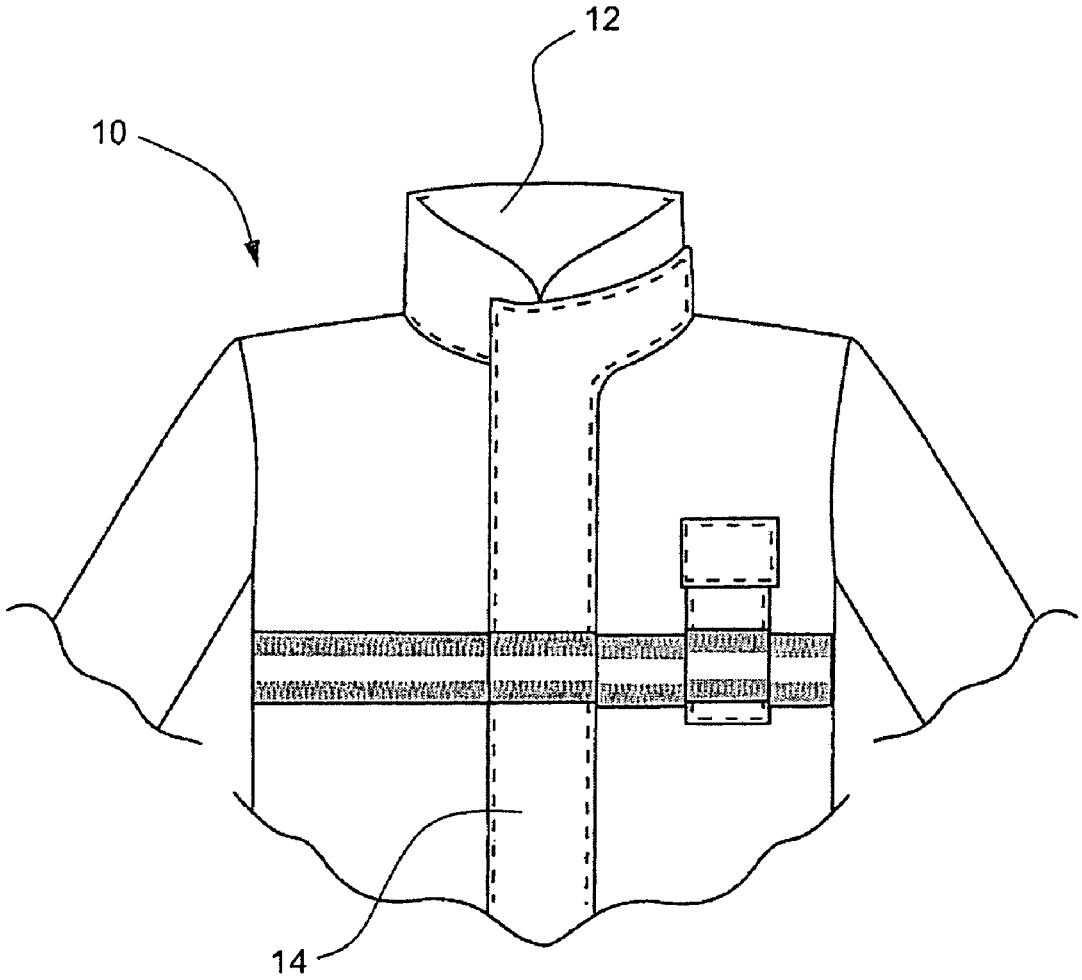
Fig. 1 (PRIOR ART)
FIG. 1 is a front schematic view of a firefighter protective jacket in accordance with the prior art.
Figure 2:
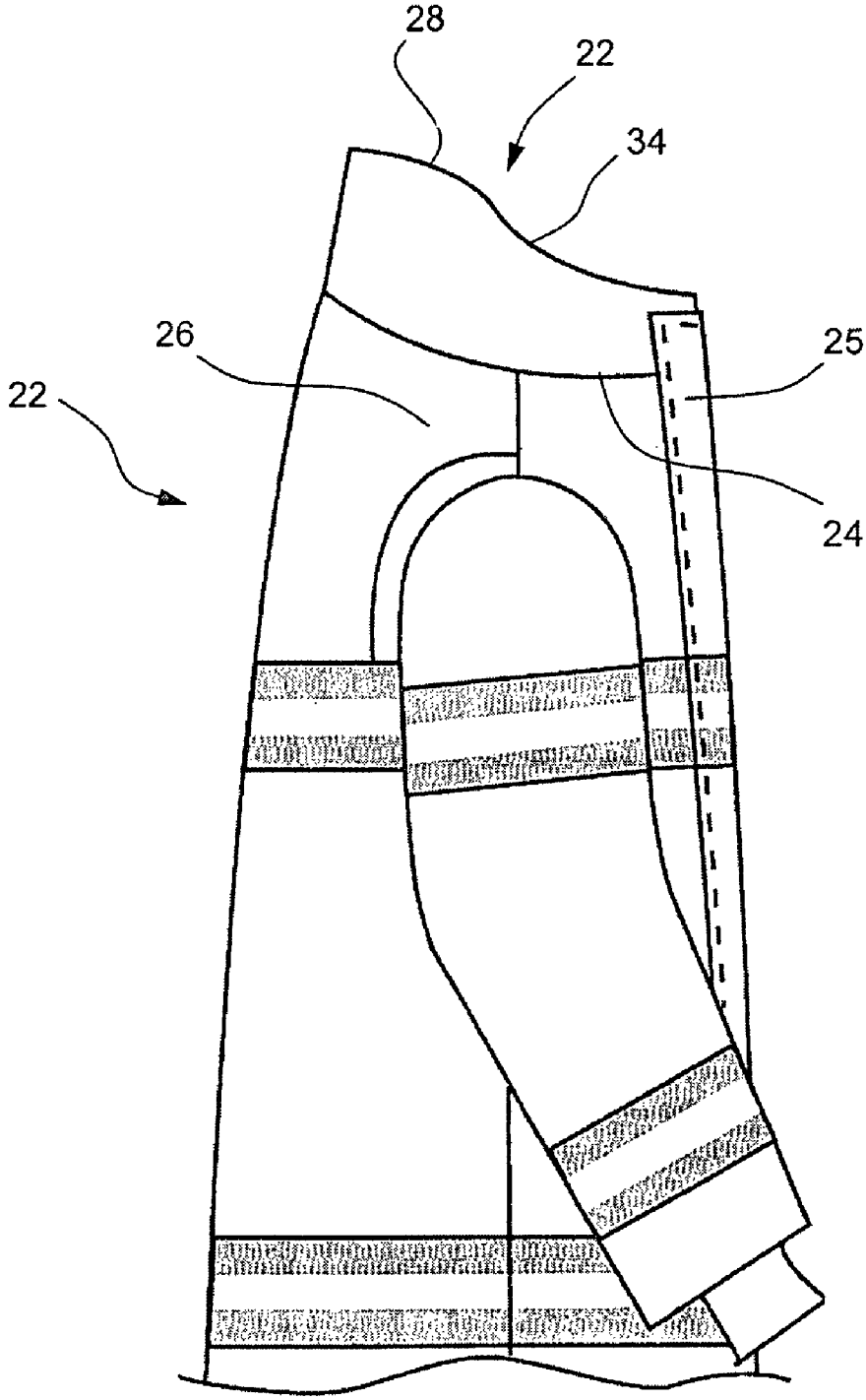
FIG. 2 is a side schematic view of a firefighter protective jacket with a variable-height collar in accordance with a first preferred embodiment of the present application.

Referring now to the drawings, and more particularly to FIG. 2, a firefighter protective jacket with a variable-height collar in accordance with a first preferred embodiment is generally shown at 20. The jacket 20 has a variable-height collar 22 having a lower edge 24 by which the collar 22 is connected to the shoulder/torso portion 26 of the jacket 20. A storm flap 25 is provided to cover the front zipped opening of the jacket 20. The upper exposed edge 28 of the collar 22 is shown having an arcuate shape, such that the height between the lower edge 24 and the upper exposed edge 28 varies along the collar 22.

The jacket 20 is provided with a collar of variable height so as to provide a better fit with adjacent equipment and/or the body shape of the firefighter.

Figure 3:
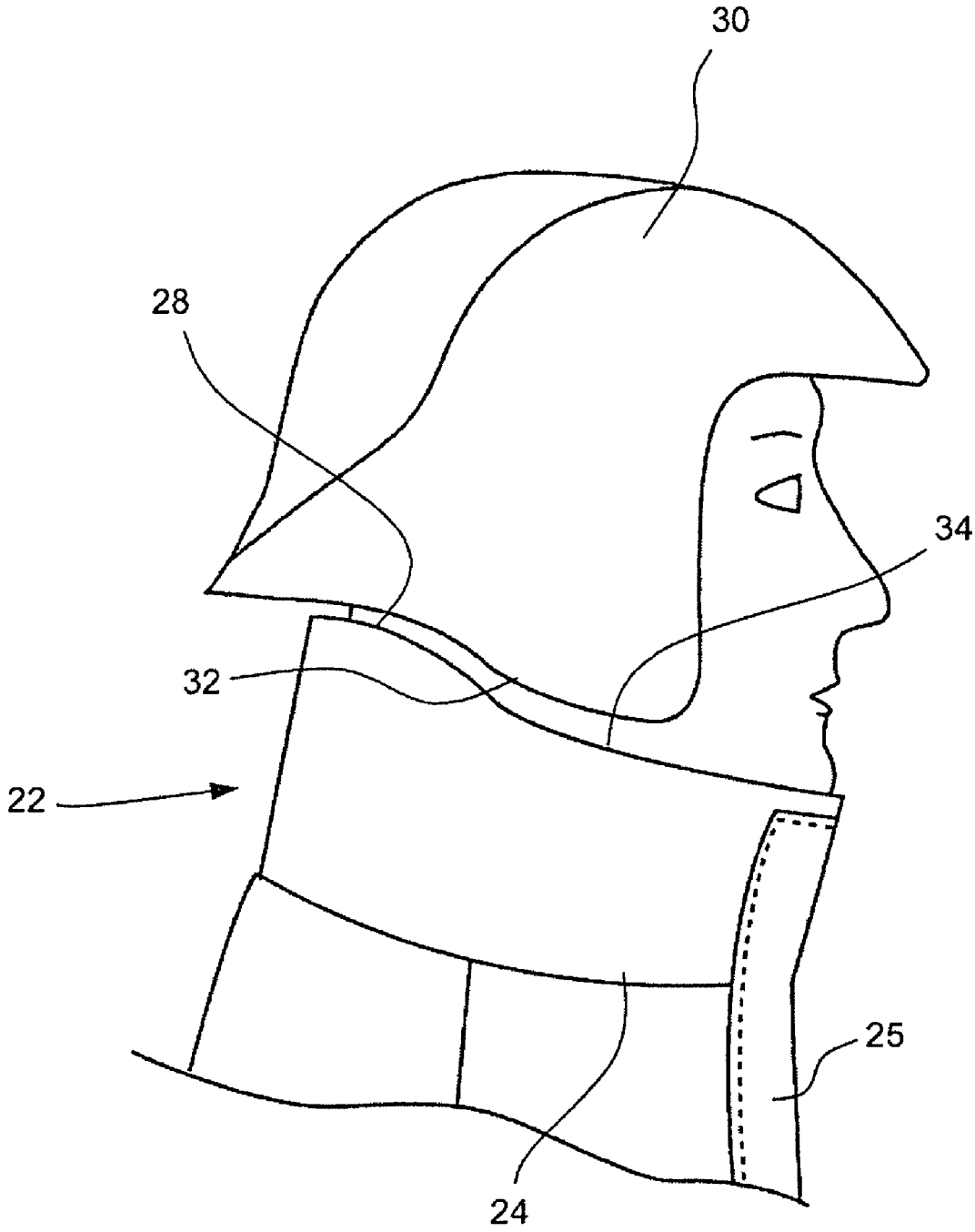
FIG. 3 is an enlarged side schematic view of the firefighter protective jacket with the variable-height collar of FIG. 2, with respect to a firefighter hood.

Referring to FIG. 3, the variable-height collar 22 is shaped as a function of a firefighter hood 30 (i.e., head gear). It is pointed out that like elements will bear like reference numerals in FIGS. 2 to 8.

The hood 30 has a lower periphery 32 having a given shape. The variable-height collar 22 is concave so as to be complementary in shape to that of the lower periphery 32 of the hood 30. More specifically, a concave edge portion 34 is defined in the upper exposed edge 28 of the collar 22.

Figure 6:
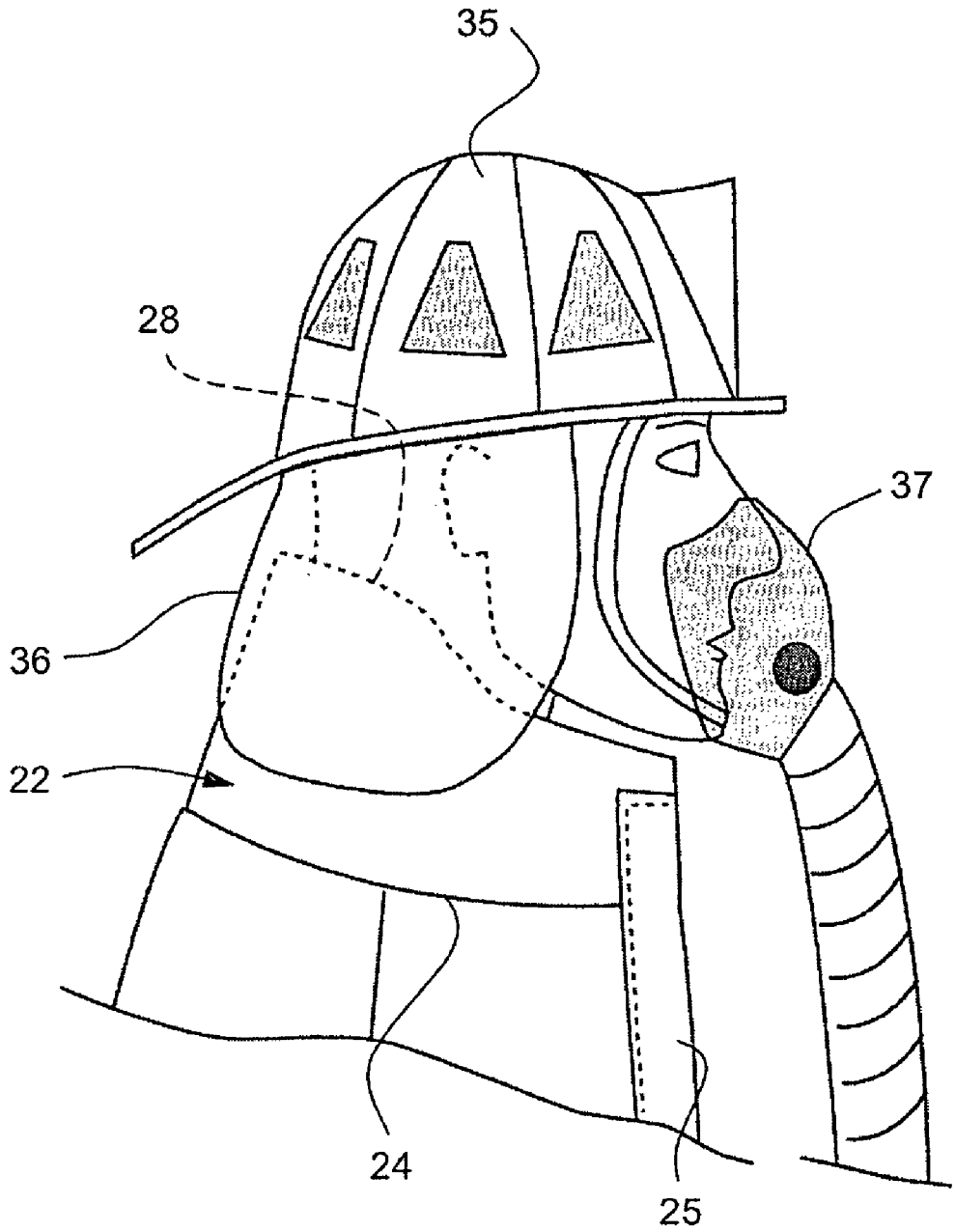
FIG. 6 is an enlarged side schematic view of the firefighter protective jacket with the variable-height collar of FIG. 2, as worn with a firefighter helmet and a breathing mask.

Referring to FIG. 6, the variable-height collar 22 is shown as worn with a firefighter helmet 35 incorporating a neck flap 36 overlying the collar 22. The wearer also ports a breathing mask 37 connected to a self-contained breathing apparatus (SCBA). The concave edge portion 34 of the collar 22 follows the shape of the jaw and chin of the wearer. The lesser height at the front of the collar 22 allows the breathing mask 37 to be used freely. The variable-height collar 22 can also be configured for use with a face mask, a helmet chin strap, earflaps, goggles, and a face shield.

This configuration of the variable-height collar 22 is such that the firefighter can freely execute movements while being suitably protected by the collar 22. The human anatomy allows multiple degrees of freedom of movement of the head with respect to the torso, and the variable-height collar 22 facilitates the movement of the wearer's head when compared to prior-art collars. Accordingly, the collar 22 does not impede the free movement of the firefighter wearing the jacket 20 and the helmet 30. Although only one side of the collar 22 is visible in FIG. 3, it is considered to provide concave edge portions 34 on both the left and right sides of the collar 22.

Figure 4:
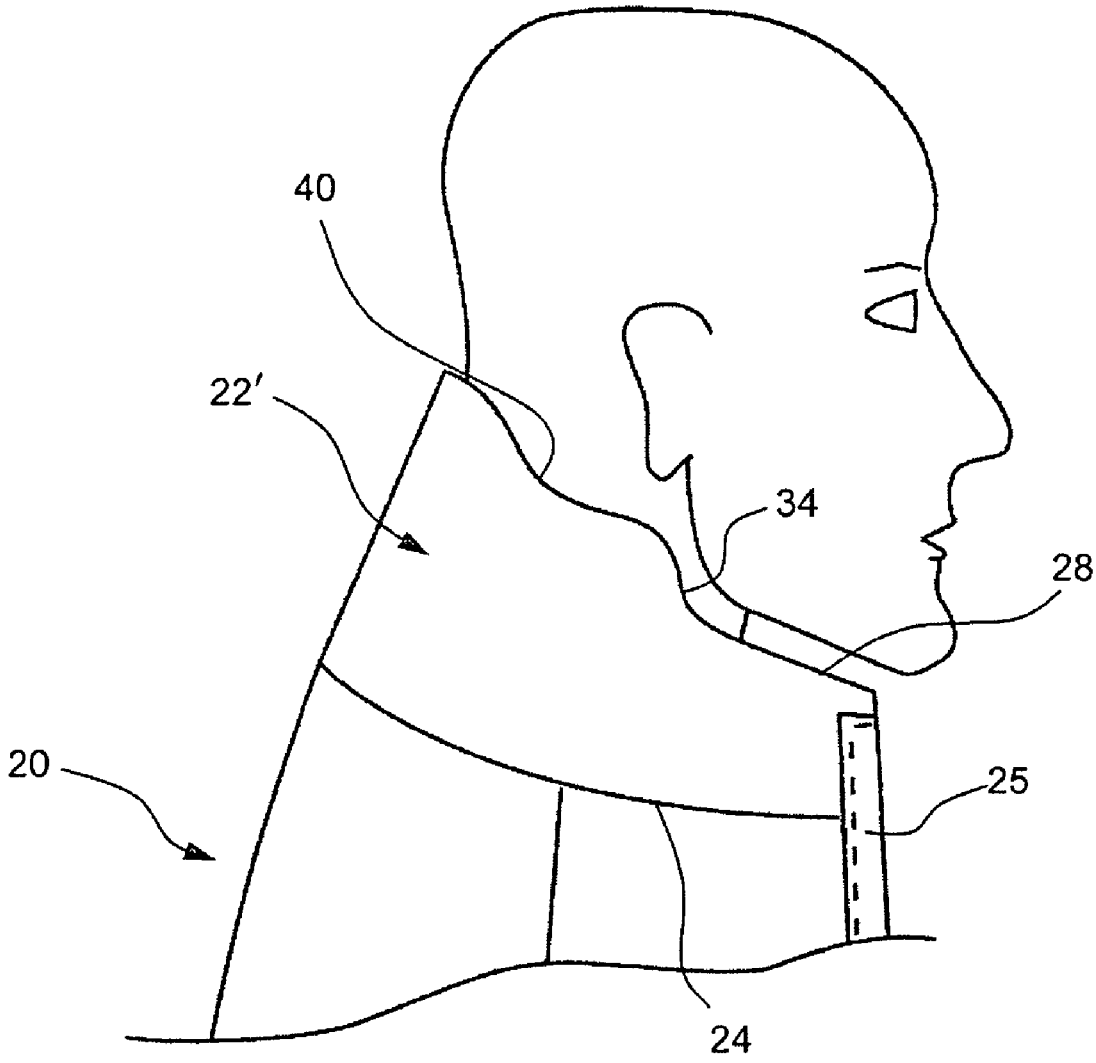
FIG. 4 is a side schematic view of a firefighter protective jacket with a variable-height collar in accordance with a second preferred embodiment of the present application, shaped to match a body shape/morphology of a firefighter.

Referring to FIG. 4, the jacket 20 is shown having a variable-height collar 22' shaped as a function of the body shape/morphology of the firefighter. More specifically, a concave edge portion 40 is defined in the upper exposed edge 28 of the collar 22'. The concave edge portion 40 is aligned with the ear of the firefighter. Accordingly, more play is provided for tilting motion of the firefighter's head without interference of the upper exposed edge 28 with the ears of the firefighter.

The variable-height collar 22' also features the concave edge portion 34 to follow the jaw and chin of the wearer. Moreover, as shown in FIG. 6, a concavity 42 is provided in the upper exposed edge 28 of the collar 22', so as to conform to the occipital region of the skull. Therefore, more play is provided for a rearward tilting motion of the firefighter's head. As the variable-height collar 22' features less material in areas opposite protruding portions of the head (e.g., ears, occiput, jaw, chin), the collar 22' will not have a tendency to bunch up when the head is tilted. The bunching up in the prior-art collars can potentially displace the protective flaps (e.g., neck flap, earflap), resulting in reduced protection of the wearer.

Although only one side of the collar 22' is visible in FIG. 4, it is considered to provide concave edge portions 34 and 40 on both the left and right sides of the collar 22'.

Figure 7:
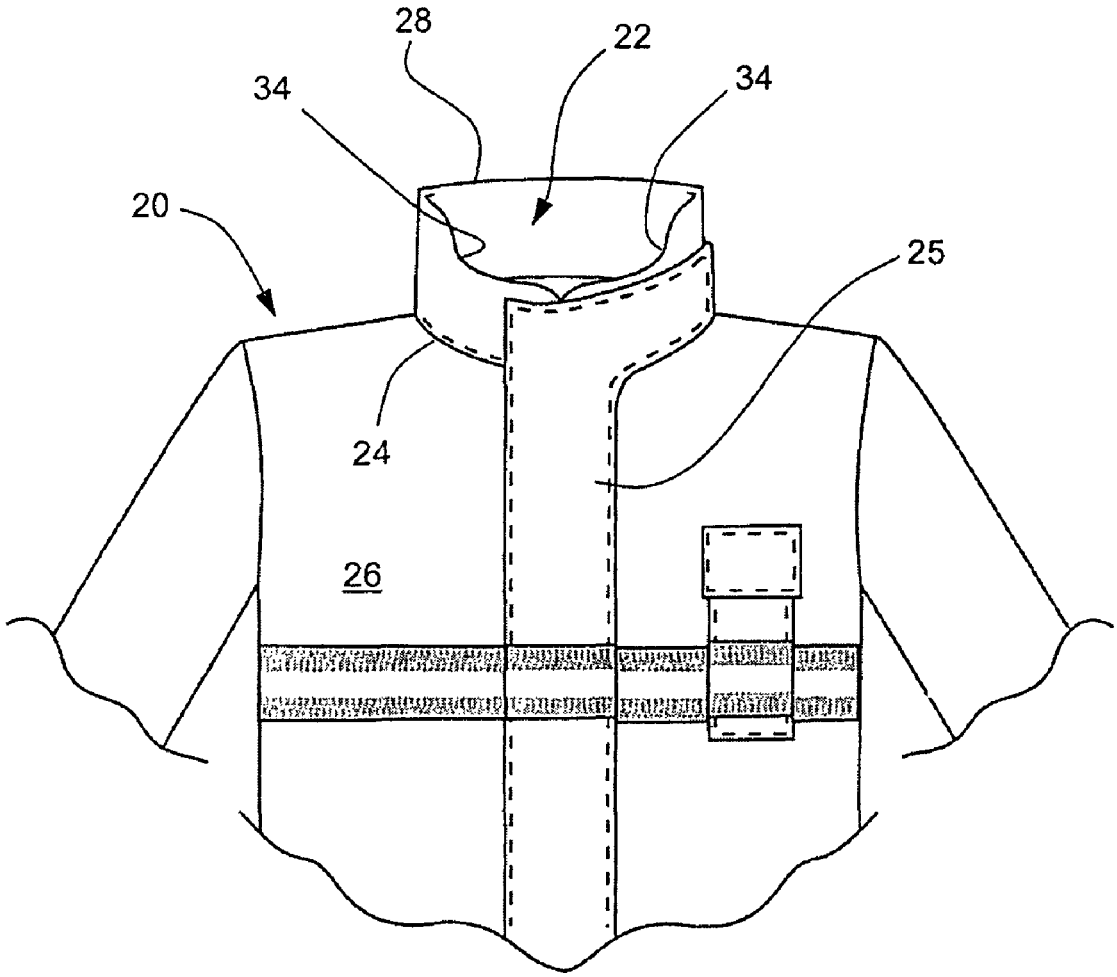
FIG. 7 is a front schematic view of the firefighter protective jacket with the variable-height collar of FIG. 2.
Figure 8:
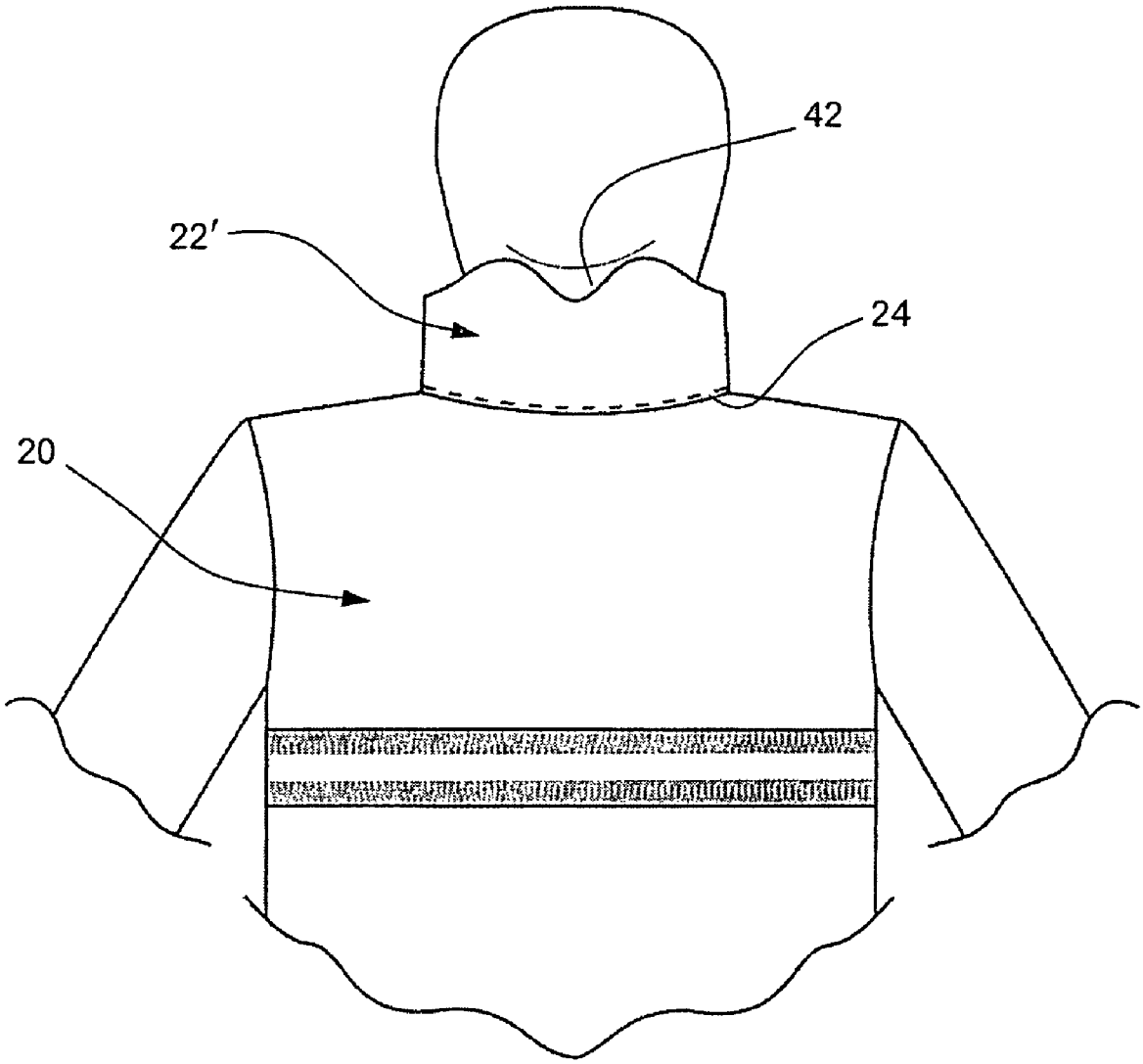
FIG. 8 is a rear schematic view of the firefighter protective jacket with the variable-height collar of FIG. 4.

Referring to FIG. 7, the protective jacket 20 having the variable-height collar 22 is shown with the storm flap 25. The storm flap 25 is a one-piece flap in an inverted-L, shape. The storm flap 25 covers the front zipped opening of the jacket 20. The flap 25 is sized so as to be below the upper exposed edge 28 of the variable-height collar 22, thereby not interfering with the chin of the wearer. Accordingly, the combination of the collar 22 and storm flap 25 is well suited to match the wearer's facial shape.

The variable-height collars 22 and 22' (FIGS. 2, 3, 4, and 8) mould the shape of the lower section of the face and/or the shape of the equipment. This will enhance the protection against water infiltration, spark exposure, and/or oppressive heat, while not impeding the movements and comfort of the firefighter.

The variable-height collars will improve comfort of the firefighter, and can also be configured to improve the visibility of the firefighter in given orientations (e.g., when the firefighter looks down). Moreover, as less fabric is used when compared to prior-art firefighter jackets with uniform-height collars, the variable-height collars are lighter.

Figure 5:
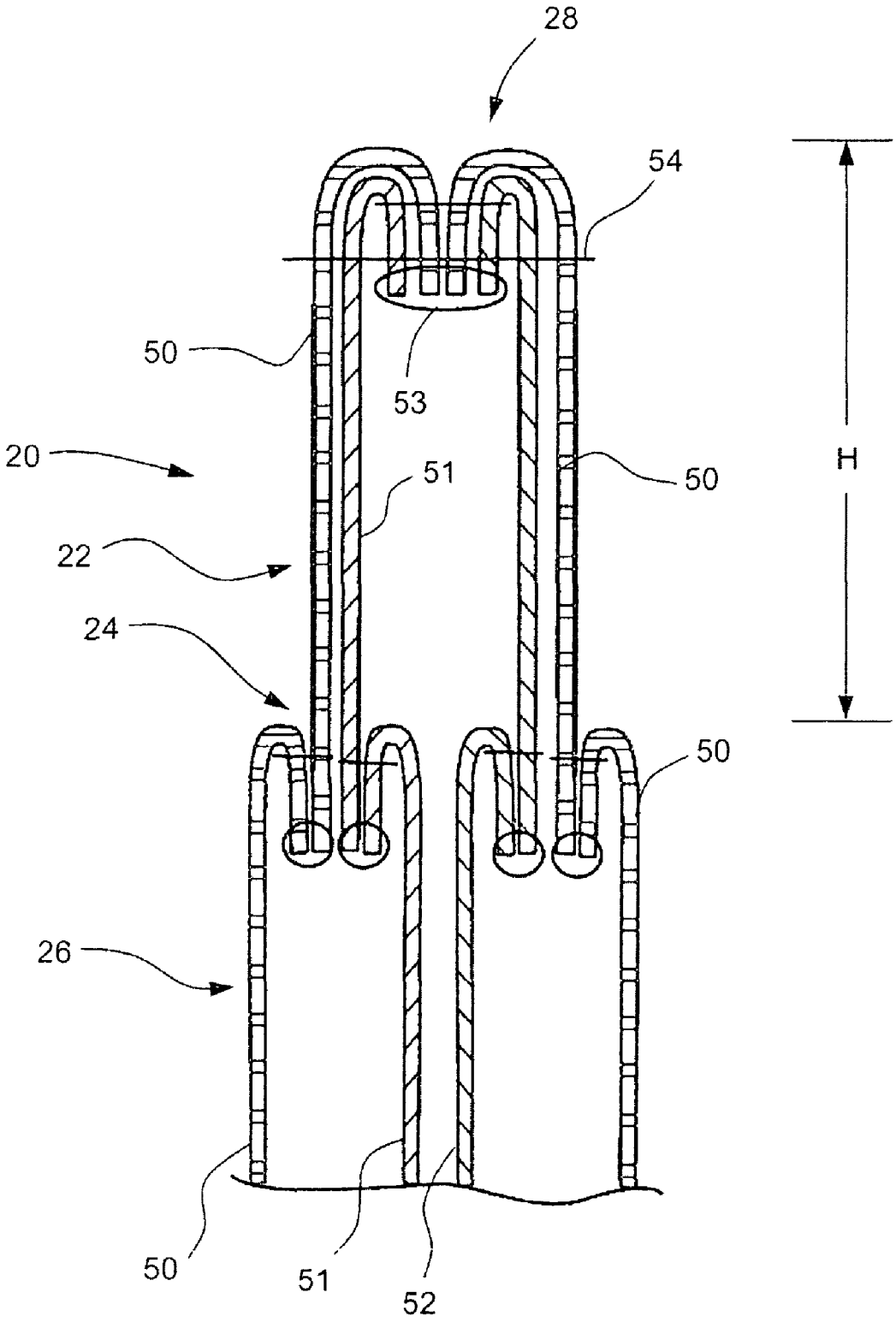
FIG. 5 is a schematic sectional view illustrating a construction of the variable-height collar of the firefighter protective jacket of the present application.

Referring to FIG. 5, a typical construction of the protective jacket 20 is illustrated. More specifically, an outer shell 50 encapsulates a thermal liner 51 and a moisture barrier 52. In order to vary the height of the collar 22, a free end 53 of the collar 22 is flipped inside the gap between the thermal liner 51 and the moisture barrier 52. The depth of insertion of the free end 53 is varied so as to create the desired variable height H of the collar 22. A thread seam 54 is made to set the height of the collar 22. The construction illustrated in FIG. 5 is one of numerous other considered constructions for the protective jacket 20.

According to the NFPA 1971-2007 standards, the height H is at least 3 inches. It is considered to vary the height H from 3 to 4 inches for the variable-height collar. Although two different embodiments have been provided for the variable-height collar, numerous other embodiments are considered, featuring curved and/or straight variable-height collars.

The protective jacket with the variable-height collar as described previously can be used as firefighter protective gear, and also as gear for structural firefighting, wildland firefighting, and as emergency medical service garment, urban search and rescue garment, and extrication garment.

The invention claimed is:

1. A jacket of the type used by firefighters as protective garment, wherein a collar of the jacket projects upwardly from a shoulder/torso portion in a protective configuration, the collar comprising a lower edge connected to the shoulder/torso portion of the jacket in a straight seam, an upper exposed edge spaced apart from the lower edge, and a given shape to the upper exposed edge such that a variable height is defined between the lower edge and the upper exposed edge along the upper exposed edge, and wherein in the protective configuration with the collar projecting upwardly the given shape is as a function of anatomical features of a wearer of the jacket and defines two opposed concave edge portions in the upper exposed edge with the concave edge portions being located on opposite sides of the collar and each extending frontwardly from an adjacent convex edge portion, the concave edge portions being in alignment with the respective jaw sides of the wearer, the given shape defining two opposed other concave edge portions in the upper exposed edge with each other concave edge portion being located in alignment with a respective ear of the wearer, each concave edge portion being connected to a respective one of the other concave edge portions through the adjacent convex edge portion.

2. The jacket according to claim 1, wherein the given shape defines a concave portion in alignment with the occiput of the wearer.

3. The jacket according to claim 1, further comprising a storm flap, with a top edge of the storm flap being positioned below the upper exposed edge of the collar when closed.

4. The jacket according to claim 3, wherein the storm flap is a one-piece flap having an inverted-L shape.

5. The jacket according to claim 1, wherein the jacket comprises an outer shell retardant to the flames, a thermal liner to provide heat insulation, and a moisture barrier to generally prevent water infiltration.

6. The jacket according to claim 1, wherein the concave edge portions are below the jaw when the jacket is worn in the protective configuration with the collar projecting upwardly.

7. The jacket according to claim 1, wherein the other concave edge portions are below the ears when the jacket is worn in the protective configuration with the collar projecting upwardly.

* * * * *